US005964384A

United States Patent [19]

Young

[11] Patent Number: 5,964,384

[45] Date of Patent: Oct. 12, 1999

[54] TRAVELING BAG WITH EXPANDABLE STORAGE VOLUME

[76] Inventor: David Young, Suite 3, 12th Floor, No. 415, Hsin Yi Road, Sec. 4, Taipei, Taiwan

[21] Appl. No.: 09/148,125

[22] Filed: Sep. 4, 1998

[51] Int. Cl.[6] ..... A45F 4/02

[52] U.S. Cl. ..... 224/153; 224/581; 224/610; 224/627; 224/664; 190/103; 190/111; 383/4; 383/40

[58] Field of Search ..... 224/101, 153, 224/581, 582, 600, 607, 610, 614, 617, 618, 620, 627, 645, 650, 652, 653, 660, 663, 664; 190/103, 109, 110, 111, 112; 383/4, 38, 40

[56] References Cited

U.S. PATENT DOCUMENTS

| | | | |
|---|---|---|---|
| 3,122,225 | 2/1964 | Ward | 190/109 X |
| 3,989,080 | 11/1976 | Koszegi | 383/40 |
| 4,018,369 | 4/1977 | Jaeger | 224/582 |
| 4,096,978 | 6/1978 | Noice | 383/40 |
| 5,119,910 | 6/1992 | Heggeland | 224/620 X |
| 5,797,529 | 8/1998 | Lavine | 383/4 X |
| 5,887,770 | 3/1999 | Covell | 224/153 |

FOREIGN PATENT DOCUMENTS

| | | | |
|---|---|---|---|
| 1474951 | 3/1967 | France | 190/103 |

*Primary Examiner*—Allan N. Shoap
*Assistant Examiner*—Gregory M. Vidovich
*Attorney, Agent, or Firm*—Raymond Y. Chan; David and Raymond

[57] ABSTRACT

A traveling bag with expandable storage volume includes an additional pack body stored inside a receiving chamber formed aside of a bag body. Generally, the additional pack body is folded and received inside the receiving chamber and the cover wall is secured with the boundary wall by means of a fastener, so that the traveling bag can be used as a waist bag or a shoulder bag to store things in the storage compartment of the bag body. When additional storage volume is needed, the user may unsecure the fastener to separate a cover wall from a boundary wall so as to open the receiving chamber. Thus the additional pack body can be unfolded and expanded from the receiving chamber to form a back pack.

20 Claims, 4 Drawing Sheets

TRAVELING BAG WITH EXPANDABLE STORAGE VOLUME

FIELD OF THE INVENTION

The present invention relates to a traveling bag, and more particularly to a traveling bag which not only functions as a waist bag or shoulder bag, but also easily expands into a full-size back pack to provide additional storage volume.

BACKGROUND OF THE PRESENT INVENTION

Traveling bag is commonly used for carrying personal goods during traveling from place to place. According to their sizes, shapes, storage volumes, and carrying methods, traveling bags can generally be classified into shoulder bags, waist bags, hand bags, and back packs.

Waist bag comprises a bag body and a waist belt having two ends connected to two sides of the bag body respectively for tightening around the user's waist, so that the user's hands are free for other purposes. Shoulder bag comprises a bag body and a longer shoulder belt having two ends connected to two sides of the bag body respectively for carrying on the user's shoulder. Back pack contains a back bag body as large as the user's back, wherein two shoulder belts are connected to a rear side of the back bag body, so that the back pack can be carried by looping two shoulder belts around the user's two shoulders respectively.

It is well known that the back pack generally contains a larger storage volume than either the waist bag or the shoulder bag. Moreover, the back pack also has a bigger carrying power since it is carried by the two strong shoulders of the user, so that the back pack can be used as a school bag to carry the heavy books or a picnic bag to carry more outdoor stuffs and tools. Sometimes, we may only need a smaller bag to carry our personal goods such as wallet, keys, notebooks, and etc. The waist bag or shoulder bag provides a good size for such usage. Therefore, most people have to spend extra expense to purchase all the waist bag, shoulder bag and the back pack for different usage.

However, occasionally, we go outside with a few personal stuffs and returning with a lot of shopping goods. But a waist bag is still a waist bag. None of the conventional waist bag or shoulder bag can selectively provide additional storage volume. Of course, we may go outside with a back pack for carrying the shopping goods but most people won't do that because it looks very stupid to carry only a few things with a relatively large pack.

SUMMARY OF THE PRESENT INVENTION

It is thus a first object of the present invention to provide a traveling bag which can be selectively functioned as a waist bag or shoulder bag and expanded into a full-size back pack.

A further object of the present invention is to provide a traveling bag with expandable storage volume, wherein the user may easily and rapidly expand the traveling bag to form a back pack providing additional storage volume without taking out the goods originally stored in the traveling bag.

Yet another object of the present invention is to provide a traveling bag that can provide additional waist support while functioning as a back pack.

Still another object of the present invention is to provide a traveling bag with expandable storage volume, which structure and manufacturing cost are as simple and cheap as a common back pack.

Accordingly, in order to accomplish the above objects, the present invention provides a traveling bag with expandable storage volume, comprising:

a bag body having a first wall, a second wall and a surrounding wall connected between the first and the second wall to define a storage compartment therein, wherein the bag body further provides a first carrying means for holding and carrying;

a boundary wall perpendicularly extended from the first wall to define a receiving chamber on the first wall;

a cover wall having an edge portion connected to an outer edge of the boundary wall, the cover wall being adapted for covering the receiving chamber surrounded by the boundary wall;

a fastening means for selectively securing the cover wall with the boundary wall; and an additional pack body having a bottom edge connected to the first wall of the bag body so that the first wall also becomes a bottom wall of the additional bag body, wherein the cover wall is attached to a front wall of the additional pack body, and the additional pack body further comprises a second carrying means connected thereto for holding and carrying purposes.

Generally, the additional pack body is folded and received inside the receiving chamber and the cover wall is secured with the boundary wall by means of the fastening means, so that the traveling bag can be used as a waist bag or a shoulder bag to store things in the storage compartment of the bag body. When additional storage volume is needed, the user may unsecure the fastening means to separate the cover wall from the boundary wall so as to open the receiving chamber. Thus the additional pack body can be unfolded and expanded from the receiving chamber to form a back pack.

DETAILED DESCRIPTION OF THE PREFERRED EMBODIMENT

Figure 1:
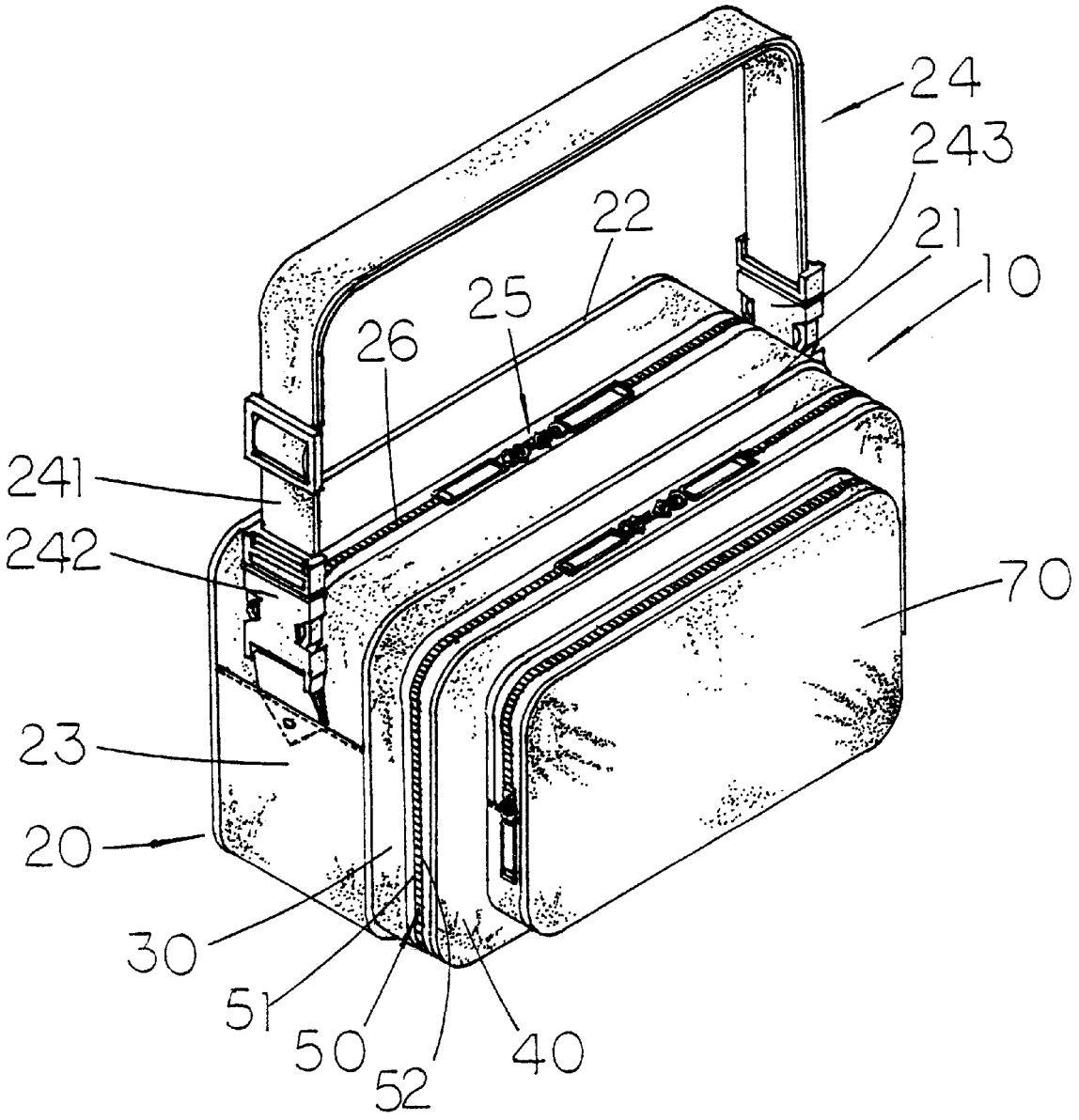
FIG. 1 is a perspective view of a traveling bag illustrating as a shoulder bag according to a preferred embodiment of the present invention.

Referring to FIGS. 1 to 4, a traveling bag 10 with expandable storage volume according to a preferred embodiment of the present invention is illustrated. The traveling bag 10 comprises a bag body 20, a boundary wall 30, a cover wall 40, a fastening means 50, and an additional pack body 60.

The bag body 20 comprises a first wall 21, a second wall 22 and a surrounding wall 23 connected between the first and the second wall 21, 22 to define a first storage compartment therein, wherein the bag body 20 further provides a first carrying means 24 for holding and carrying purposes.

According to the preferred embodiment, the first wall 21 and the second wall 22 are identically in rectangular shape.

Supporting boards can be attached to the first wall 21 and the second wall 22 to reinforce and support them for heavy loading. The surrounding wall 23 which has a predetermined width is extended around the periphery of the first and the second wall 21, 22, wherein the two sides of the surrounding wall 23 are integrally connected along the four edges of the first wall 21 and the four edges of the second wall 22 respectively.

The bag body 20 has a side opening and further comprises a zipper 25 for closing the side opening. The first carrying means 24 comprises an extensible belt 241 having two ends detachably connected to two sides of the bag body 20 by two quick release buckles 242, 243 respectively. The storage compartment of the bag body 20 has a smaller storage volume for storing personal stuffs.

The boundary wall 30 has a length equal to the total length of the four edges of the first wall 21 and a predetermined width. The boundary wall 30 is arranged in rectangular ring shaped, wherein one side of the boundary wall 30 is integrally connected to the four edges of the first wall 21, so that the boundary wall 30 is perpendicularly extended from the first wall 21 to define a receiving chamber 31 on the first wall 21.

Figure 2:
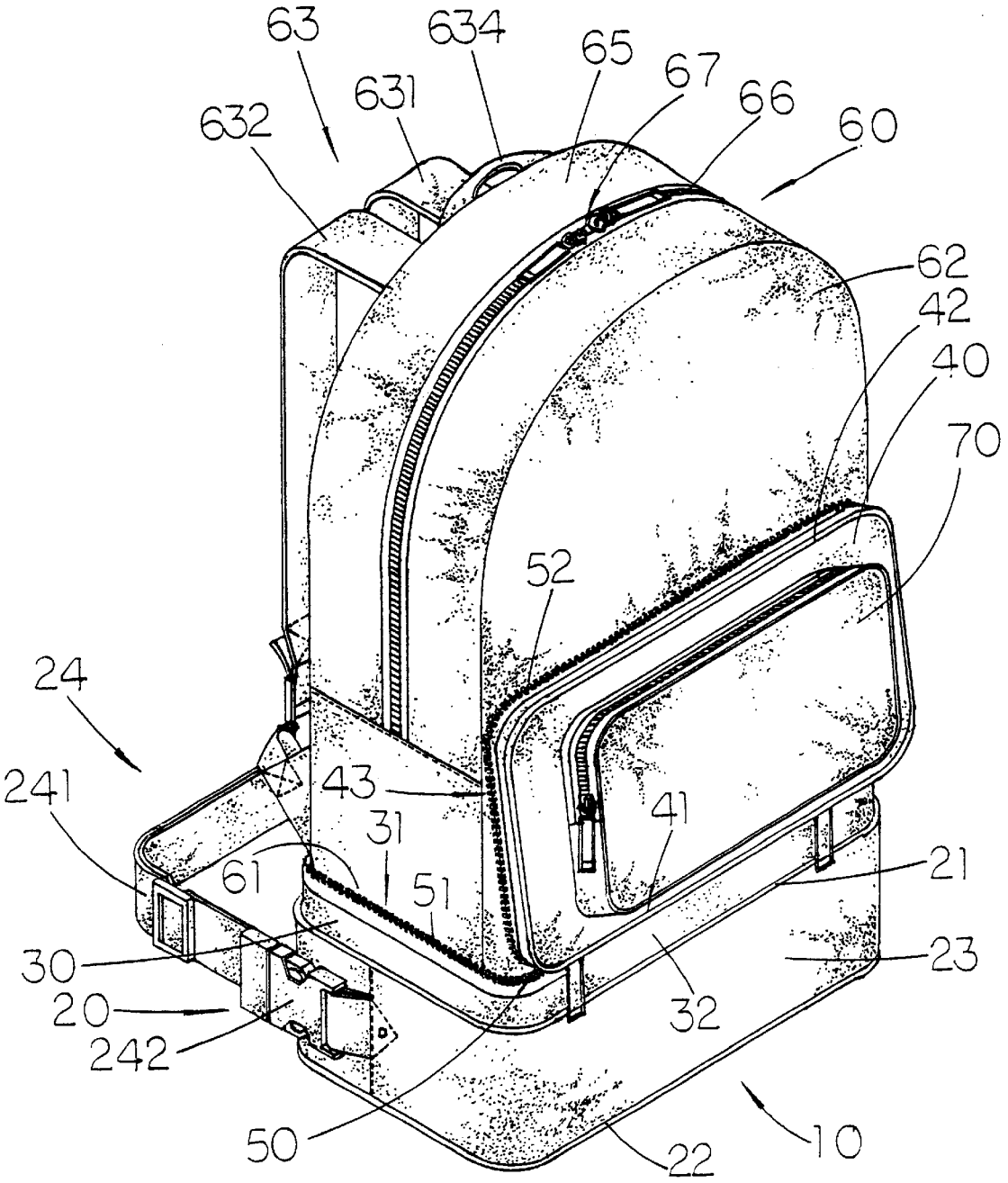
FIG. 2 is a front perspective view of the traveling bag illustrating as a back pack according to the above preferred embodiment of the present invention.

The cover wall 40 is in rectangular shape and has four edges for covering the receiving chamber 31 surrounded by the boundary wall 30. The total length of the four edges is equal to the length of the boundary wall 30. As shown in FIG. 2, at least an edge portion 41 of the cover wall 40 is integrally connected to an outer edge 32 of the boundary wall 30.

The fastening means 50 for selectively securing the cover wall 40 with the boundary wall 30 comprises a zipper having a first zipper half 51 connected to another side of the boundary wall 30 and a second zipper half 52 connected to the edges of the cover wall 40. Therefore, by securing the first zipper half 51 and the second zipper half 52 can close the receiving chamber 31. It is worth to mention that alternative fastening means such as hook and loop fastener can be used to substitute the fastening means 50 of the present embodiment to close the receiving chamber 31.

The additional pack body 60 has a bottom edge 61 integrally connected to the first wall 21 of the bag body 20, so that the first wall 21 also becomes a bottom wall of the additional bag body 60. Alternatively, the bottom edge 61 can also be integrally connected to the boundary wall 30.

As shown in FIG. 2, the cover wall 40 is attached to a front wall 62 of the additional pack body 60, and the additional pack body 60 further comprises a second carrying means 63 connected thereto for holding and carrying purposes.

Figure 4:
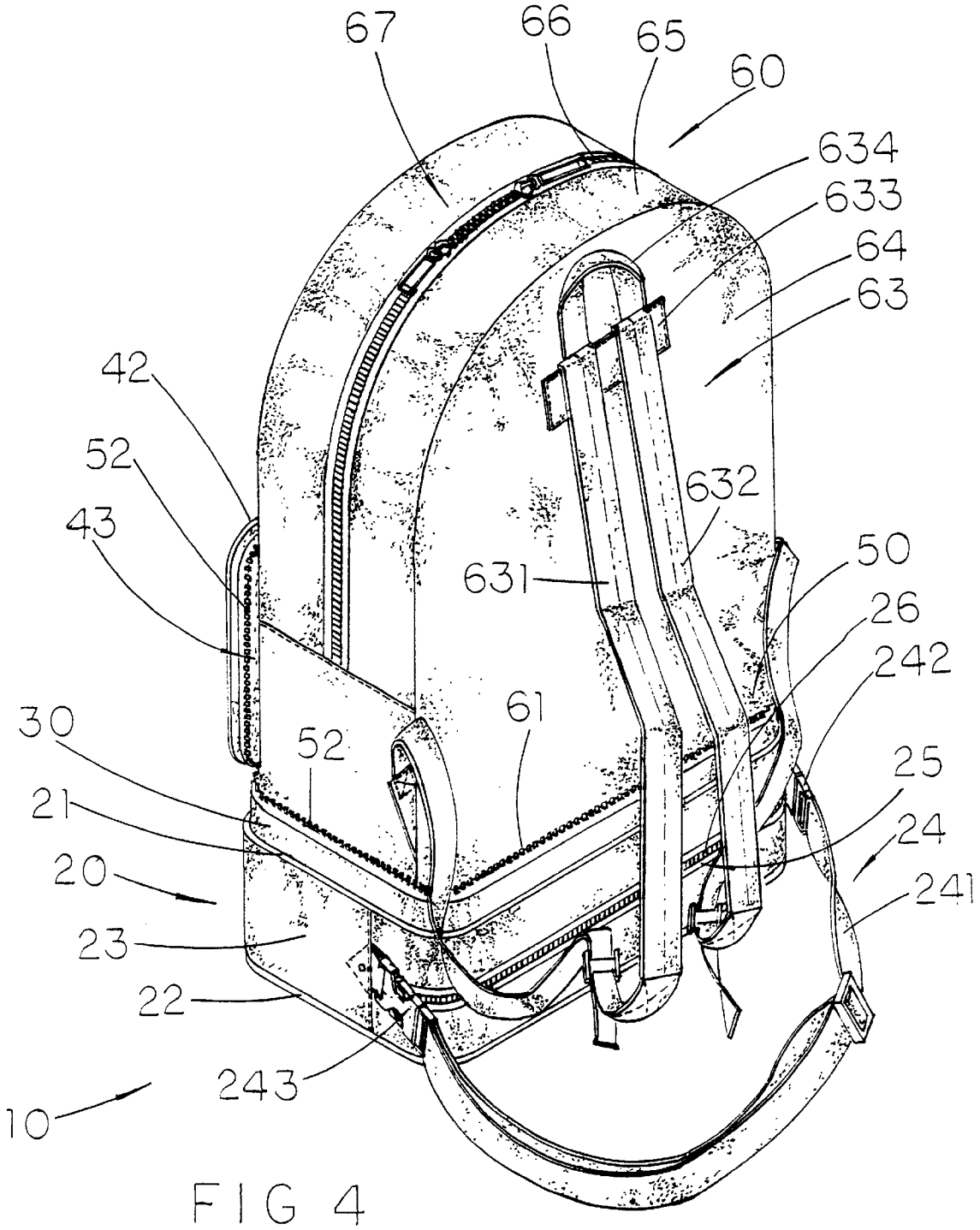
FIG. 4 is a rear perspective view of the traveling bag illustrating as a back pack according to the above preferred embodiment of the present invention.

As shown in FIGS. 2 and 4, according to the preferred embodiment, only the top edge 42 of the cover wall 40 is connected to the front wall 62 of the additional pack body 60 so as to define a receiving sleeve 43 between the cover wall 40 and the front wall 62 for holding umbrella or newspaper.

As shown in FIG. 4, the additional pack body 60 further comprises a back wall 64, a U-shaped side wall 65 connected between the front wall 62 and the back wall 64, and a zipper 66 provided along the side wall 65 for closing the interior storage cavity 67 inside the additional pack body 60.

As shown in FIG. 4, the second carrying means 63 comprises a first and a second extensible shoulder belt 631, 632, and a holder pad 633 affixed to an upper portion of back wall 64 of the additional pack body 60. Each of the first and second extensible shoulder belts 631, 632 has one end connected to the holder pad 633 while the two other ends of the first and second extensible shoulder belts 631, 632 are respectively connected to the lower portions of two side edges of the back wall 64 of the additional pack body 60. A holding strip 634 is affixed to the holder pad 633 for hand carrying.

Figure 3:
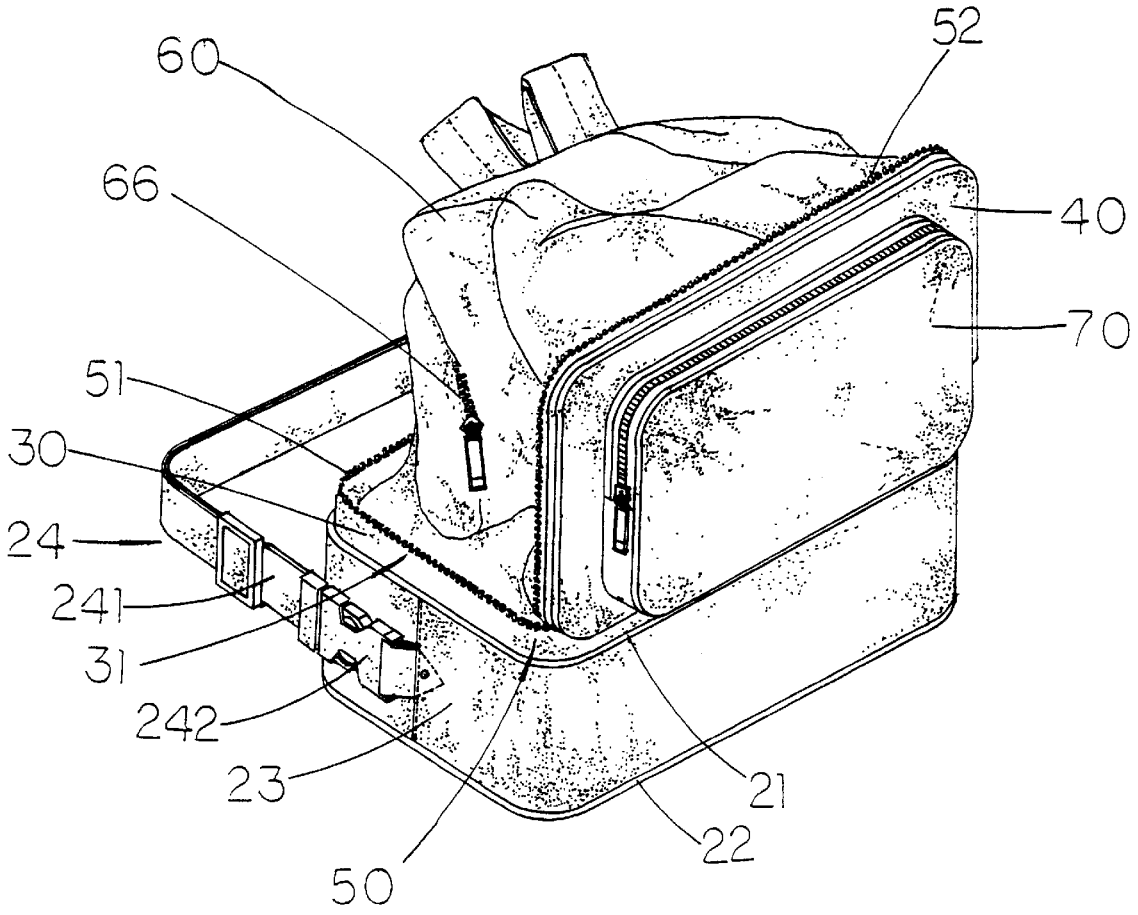
FIG. 3 is an end view of the traveling bag according to the above preferred embodiment, wherein the cover wall and the boundary wall are separated for illustrating the additional pack body stored therebetween.

As shown in FIGS. 1 to 3, the traveling bag 10 of the present invention further comprises an outside pocket 70 which is affixed outside the cover wall 40 for providing additional storage room.

As shown in FIG. 3, the additional pack body 60 is generally folded and received inside the receiving chamber 31, wherein the cover wall 40 is secured with the boundary wall 30 by means of the fastening means 50, as shown in FIG. 1. Thus the traveling bag 10 can be used as a waist bag or a shoulder bag to store things in the bag body 20. The user may use the extensible belt 241 to carry the traveling bag 10 on his or her shoulder. Alternatively, the user may also tighten the extensible belt 241 around his or her waist to use as a waist bag. Therefore, the user may store his or her personal things inside both the bag body 20 and the outside pocket 70 during traveling.

When additional storage volume is needed, the user may unfasten the fastening means 50, i.e. to unzip the zipper, to separate the cover wall 40 from the boundary wall 30 so as to open the receiving chamber 31. Thus the additional pack body 60 can be unfolded and expanded from the receiving chamber 31 to form a back pack structure, as shown in FIGS. 2 to 4. It is worth to emphasis that when the user expanding the traveling bag 10 of the present invention to the back pack structure, the user does not need to take out the storing things inside the bag body 20 and the outside pocket 70, but that the additional pack body 60 would provide additional storage volume for the user to carry extra goods by hand carrying or shoulder carrying.

An unexpected result is also achieved for the present invention as follows. That is when the traveling bag 10 is expanded to the back pack structure as shown in FIG. 4, the traveling bag 10 properly needs to carry more goods and being heavy loaded. The user may take advantage of the extensible belt 241 to fittedly wrap around the user's waist to form a waist support for sharing the shoulder loading to prevent unwanted injury to the user's waist.

What is claimed is:

1. A traveling bag with expandable storage volume, comprising:

a bag body having a first wall, a second wall and a surrounding wall connected between said first and said second wall to define a storage compartment therein, wherein said bag body further provides a first carrying means for holding and carrying;

a boundary wall perpendicularly extended from said first wall to define a receiving chamber on said first wall;

a cover wall having an edge portion connected to an outer edge of said boundary wall, said cover wall being adapted for covering said receiving chamber surrounded by said boundary wall;

a fastening means for selectively securing said cover wall with said boundary wall; and an additional pack body having a bottom edge connected to said first wall of said bag body, wherein said cover wall is attached to a front wall of said additional pack body, and said additional pack body further comprises a second carrying means connected thereto for holding and carrying purposes so that said first wall becomes a bottom wall of said additional bag body when said traveling bag is held and carried by said second carrying means;

thereby, when said additional pack body is folded and received inside said receiving chamber and said cover wall is secured with said boundary wall by means of said fastening means, said traveling bag is capable of use as a waist bag or a shoulder bag by said first carrying means to store things in said storage compartment of said bag body, and that when said cover wall is separated from said boundary wall by unsecuring said fastening means to open said receiving chamber, said additional pack body is able to be unfolded and expanded from said receiving chamber to provide additional storage volume.

2. A traveling bag as recited in claim 1 wherein said first carrying means comprises an extensible belt having two ends respectively connected to two sides of said bag body.

3. A traveling bag as recited in claim 2 wherein said two ends of said extensible belt is detachably connected to said two sides of said bag body by two quick release buckles respectively.

4. A traveling bag as recited in claim 2 wherein said first wall and said second wall are identically in substantially rectangular shape, said surrounding wall which has a predetermined width being extended around the periphery of said first and said second wall, wherein two sides of said surrounding wall are integrally connected along four edges of said first wall and four edges of said second wall respectively, and that said bag body has a side opening and further comprises a zipper for closing said side opening.

5. A traveling bag as recited in claim 4 wherein said boundary wall has a length equal to a total length of said four edges of said first wall and a predetermined width, said boundary wall being arranged in substantially rectangular ring shaped, wherein one side of said boundary wall is integrally connected to said four edges of said first wall.

6. A traveling bag as recited in substantially claim 5 wherein said cover wall is in rectangular shape and has four edges for covering said receiving chamber surrounded by said boundary wall, a total length of said four edges of said cover wall being equal to said length of said boundary wall.

7. A traveling bag as recited in claim 1 wherein said fastening means for selectively securing said cover wall with said boundary wall comprises a zipper having a first zipper half connected to a free side of said boundary wall and a second zipper half connected to edges of said cover wall.

8. A traveling bag as recited in claim 2 wherein said fastening means for selectively securing said cover wall with said boundary wall comprises a zipper having a first zipper half connected to a free side of said boundary wall and a second zipper half connected to edges of said cover wall.

9. A traveling bag as recited in claim 6 wherein said fastening means for selectively securing said cover wall with said boundary wall comprises a zipper having a first zipper half connected to a free side of said boundary wall and a second zipper half connected to edges of said cover wall.

10. A traveling bag as recited in claim 1 wherein only a top edge of said cover wall is connected to said front wall of said additional pack body to define a receiving sleeve between said cover wall and said front wall.

11. A traveling bag as recited in claim 7 wherein only a top edge of said cover wall is connected to said front wall of said additional pack body to define a receiving sleeve between said cover wall and said front wall.

12. A traveling bag as recited in claim 9 wherein only a top edge of said cover wall is connected to said front wall of said additional pack body to define a receiving sleeve between said cover wall and said front wall.

13. A traveling bag as recited in claim 1 wherein said additional pack body further comprises a back wall, a U-shaped side wall connected between said front wall and said back wall, and a zipper provided along said side wall for closing an interior storage cavity inside said additional pack body, wherein said second carrying means comprises a first and a second extensible shoulder belt and a holder pad affixed to an upper portion of said back wall of said additional pack body, each of said first and second extensible shoulder belts having one end connected to said holder pad while said two other ends of said first and second extensible shoulder belts are respectively connected to lower portions of said back wall of said additional pack body.

14. A traveling bag, as recited in claim 13, further comprising a holding strip affixed to said holder pad for hand carrying.

15. A traveling bag as recited in claim 7 wherein said additional pack body further comprises a back wall, a U-shaped side wall connected between said front wall and said back wall, and a zipper provided along said side wall for closing an interior storage cavity inside said additional pack body, wherein said second carrying means comprises a first and a second extensible shoulder belt and a holder pad affixed to an upper portion of said back wall of said additional pack body, each of said first and second extensible shoulder belts having one end connected to said holder pad while said two other ends of said first and second extensible shoulder belts are respectively connected to lower portions of said back wall of said additional pack body.

16. A traveling bag as recited in claim 9 wherein said additional pack body further comprises a back wall, a U-shaped side wall connected between said front wall and said back wall, and a zipper provided along said side wall for closing an interior storage cavity inside said additional pack body, wherein said second carrying means comprises a first and a second extensible shoulder belt and a holder pad affixed to an upper portion of said back wall of said additional pack body, each of said first and second extensible shoulder belts having one end connected to said holder pad while said two other ends of said first and second extensible shoulder belts are respectively connected to lower portions of said back wall of said additional pack body.

17. A traveling bag as recited in claim 12 wherein said additional pack body further comprises a back wall, a U-shaped side wall connected between said front wall and said back wall, and a zipper provided along said side wall for closing an interior storage cavity inside said additional pack body, wherein said second carrying means comprises a first and a second extensible shoulder belt and a holder pad affixed to an upper portion of said back wall of said additional pack body, each of said first and second extensible shoulder belts having one end connected to said holder pad while said two other ends of said first and second extensible shoulder belts are respectively connected to lower portions of said back wall of said additional pack body.

18. A traveling bag, as recited in claim 1, further comprising an outside pocket which is affixed outside said cover wall for providing additional storage room.

19. A traveling bag, as recited in claim 15, further comprising an outside pocket which is affixed outside said cover wall for providing additional storage room.

20. A traveling bag, as recited in claim 17, further comprising an outside pocket which is affixed outside said cover wall for providing additional storage room.

* * * * *